US009003847B2

(12) United States Patent
Bammer et al.

(10) Patent No.: US 9,003,847 B2
(45) Date of Patent: Apr. 14, 2015

(54) DEVICE AND METHOD FOR BENDING A WORKPIECE

(75) Inventors: Ferdinand Bammer, Vienna (AT); Dieter Schuoecker, Vienna (AT); Armin Rau, Neuhofen (AT); Joachim Aichinger, Ansfelden (AT); Gerhard Sperrer, Oberschlierbach (AT); Thomas Schumi, Vienna (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 568 days.

(21) Appl. No.: 13/381,187

(22) PCT Filed: Jun. 29, 2010

(86) PCT No.: PCT/AT2010/000237

§ 371 (c)(1),
(2), (4) Date: Mar. 14, 2012

(87) PCT Pub. No.: WO2011/000013

PCT Pub. Date: Jan. 6, 2011

(65) Prior Publication Data

US 2012/0160002 A1 Jun. 28, 2012

(30) Foreign Application Priority Data

Jun. 29, 2009 (AT) ..... A 1008/2009

(51) Int. Cl.
*B21D 5/02* (2006.01)
*B21D 37/16* (2006.01)

(52) U.S. Cl.
CPC ..... *B21D 5/0209* (2013.01); *B21D 37/16* (2013.01)

(58) Field of Classification Search
CPC ..... B21D 37/16; B21D 5/00; B21D 5/02; B21D 5/0209; B21J 1/06; B21K 29/00; B23K 26/0738
USPC ..... 72/389.3, 342.1
See application file for complete search history.

(56) References Cited

U.S. PATENT DOCUMENTS 3,740,996 A * 6/1973 Hix ..... 72/461
4,550,586 A 11/1985 Aubert et al.

(Continued)

FOREIGN PATENT DOCUMENTS

AT 411 023 9/2003
DE 195 14 285 6/1996

(Continued)

OTHER PUBLICATIONS

International Search Report of PCT/AT2010/000237, Oct. 12, 2010.

(Continued)

*Primary Examiner* — Teresa M Ekiert
(74) *Attorney, Agent, or Firm* — Collard & Roe, P.C.

(57) ABSTRACT

The invention relates to a method for bending a flat workpiece (2), comprising the discharge of high-energy radiation (19) in the form of at least one planar fanned beam (24) from a bending recess (12) of a die arrangement (3) having a bending die (7) onto a workpiece (2) bearing against a contact surface (11) of the bending die (7) for the local heating thereof before and/or during a bending process. The one or more planar fanned beams (24; 24*a*. 24*b*, . . . ) are produced by a number of optionally activatable radiation sources (22*a*, 22*b*, . . . ) which are arranged within the die arrangement (3) along the bending recess (12) or are caused by the distribution of a concentrated radiation beam (40) that is introduced from a radiation source (39) outside the bending dies (7*a*, 7*b*, . . . ) via a number of beam affecting arrangements (23*a*, 23*b*, . . . ) within the bending dies (7*a*, 7*b*, . . . ) and the exiting radiation (19) is thereby adjusted to the bending length (21) of the workpiece to be bent (2) via the number of planar fanned beams (24, 24*a*, 24*b*, . . . ).

24 Claims, 4 Drawing Sheets

(56) References Cited

U.S. PATENT DOCUMENTS

Figure 1:
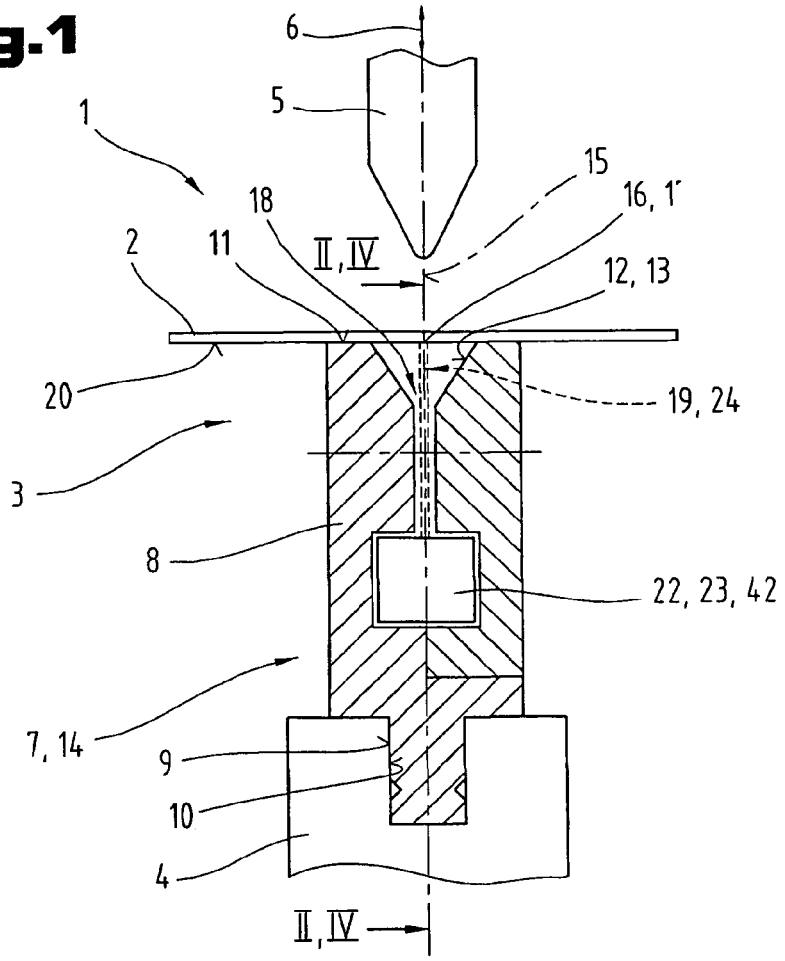

| | | | |
|---|---|---|---|
| 5,359,872 | A | 11/1994 | Nashiki |
| 6,251,328 | B1 | 6/2001 | Beyer et al. |
| 6,415,639 | B1 | 7/2002 | Kilian et al. |

FOREIGN PATENT DOCUMENTS

| | | |
|---|---|---|
| EP | 0 108 718 | 5/1984 |
| EP | 0 993 345 | 4/2000 |
| EP | 1 961 502 | 8/2008 |
| JP | 1-233019 | 9/1989 |
| JP | 2-280930 | 11/1990 |
| JP | 5-096329 | 4/1993 |
| JP | 2003-311331 | 11/2003 |
| JP | 2004-034074 | 2/2004 |

OTHER PUBLICATIONS

English Translation of International Preliminary Report on Patentability and Written Opinion of the International Searching Authority in PCT/AT2010/000237, Jan. 17, 2012.

* cited by examiner

DEVICE AND METHOD FOR BENDING A WORKPIECE

CROSS REFERENCE TO RELATED APPLICATIONS

This application is the National Stage of PCT/AT2010/000237 filed on Jun. 29, 2010, which claims priority under 35 U.S.C. §119 of Austrian Application No. A 1008/2009 filed on Jun. 29, 2009. The international application under PCT article 21(2) was not published in English.

The invention relates to a method for bending a flat workpiece as well as a bending die for performing the method.

For a long time, the bending of workpieces has been a frequently applied and reliable method for processing workpieces by deforming. The scope of application of bending processes is frequently limited by material properties, especially by the mechanic-technological properties. The problem concerning brittle materials like magnesium, titanium, spring steels, high-strength aluminum-alloys, high-strength steels or other materials known to be brittle is that in case of a deforming by bending, these materials do not provide sufficient plastic formability and thus other undesired deformations appear. A parameter that can indicate the respective behavior of materials is the so-called ultimate strain that means the value of the plastic deformation that a workpiece to be deformed can bear until it breaks. An alternative parameter for this behavior is also the so-called yield strength to tensile strength ratio that considers the tension required in a workpiece at the beginning of a noticeable plastic deformation in relation to the tension within the workpiece in case of breaking load.

In order to make such materials accessible to the application of a deformation methods, especially to bending, methods putting the workpiece into a condition providing more favorable mechanic characteristics and enabling it to be deformed by means of a bending method have been applied for a while. A known method is heating the workpiece to be bent at least in the region of the deformation zone, with the result that in this heated area the tension necessary for initiating of plastic deformation can be reduced.

As an example of such a method, the EP 0 993 345 A1 discloses a method for bending a workpiece by application of mechanic force under selective heating of the workpiece along a bending line by means of a laser beam, where one laser beam or several laser beams are formed to be an elongate radiation field and where a heating zone along the bending line of the workpiece is created by the radiation field. In this case, the device for forming the linear radiation field comprises cylindrical lenses and/or cylindrical mirrors, which are used to guide a radiation field through the opening in the bending die onto the workpiece. In the exemplary embodiment according to FIG. 4 of the EP-A1, a laser beam is split into two radiation fields by means of a beam forming optic, which consists of a prism mirror, two cylindrical lenses and two cylindrical passive deflectors. The two radiation fields are guided through the bending die onto the workpiece and generate respective linear heating zones. The laser beam deformed this way is thus guided onto the workpiece through a slot-like opening in the bottom side of the die.

This solution for the guiding of high-energy radiation in a bending die known from the EP 0 993 345 A1 is not ideally suited for the practical application with common bending machines, because the bending die provides a limited mechanical strength due to its two-piece embodiment and the press beam receiving the bending die would have to provide recesses for the beam distribution arrangement. Furthermore, the method described in the EP-A1 is only restrictedly suitable for the bending of smaller workpieces; because the high-energy radiation is always spread over the entire length of the workpiece.

The object of the invention is to provide a bending die that is applicable to a bending method according to its genre, which is better applicable for practical application and is also suitable for worpieces with different dimensions with simultaneously meeting the high re-quirements regarding job safety.

The object is achieved by a method according to one aspect of the invention as well as a die arrangement with characteristics according to another aspect of the invention.

Due to the fact that the radiation emitting through the bending recess is adjusted to the workpiece to be bent by controlled local generation of radiation within the die arrangement by means of several optionally activatable radiation sources or by means of controlled distribution of a concentrated radiation beam by beam affecting means within the die arrangement and can be restricted to a section of the bending recess, if applicable, on the one hand, the radiation energy required for the local heating of the workpiece is minimized, and on the other hand, a possible endangering by radiation for an operator being in the environment of the bending tool is reduced, because the proportion of the radiation that does not hit the workpiece is strongly reduced due to this measures.

The controlled local generation of the radiation is in this case effected by several radiation sources that are arranged along the bending recess within the bending die and that emit radiation with a low light density, but in total, however, have a larger total beam exit area than one single high concentrated focused radiation source. As radiation sources, in particular diode laser bars are suitable, which have a strip-shaped beam exit area, for example the dimension of 10 mm length and 1 mm width. The longitudinal axis of the strip-shaped beam exit area is in this case orientated into the longitudinal direction of the groove-like bending recess, with the result that a distribution of the radiation along the bending recess takes almost place due to the form of the beam exit area. Due to the fact that several radiation sources are arranged within the bending die, single or several of them can keep deactivated during the heating of the workpiece, with the result that at the section of the beam exit opening being above the deactivated radiation sources no or only very little radiation emits.

In order to achieve an even distribution of the radiation within the die arrangement or in the region of the bending recess, which the deformation zone of the workpiece bears against, by beam affecting arrangements, the latter comprise at least one optical element that can deflect, split or form high-energy radiation introduced by an external radiation source. For this purpose, optical elements, like for example in form of lenses, mirrors, polarization filters, beam splitter elements, FTIR elements, (frustrated total internal reflection), half-wave plates and combinations thereof form the beam affecting arrangement in the interior of the bending dies. Due to possibilities of adjustment at single or several component parts, there is additionally the possibility to discharge the radiation emitted by the radiation source out of the bending die into different sections of the beam exit opening and thus adjusted to a workpiece and/or to deflect portions of the radiation to other regions within the same or an adjacent bending die, with the result that the radiation is absorbed within the bending die and does not leave the latter through the beam exit opening. Additionally, to prevent radiation generated in the die arrangement or radiation introduced into the bending die from an external radiation source from discharging through the beam exit opening into section of a bending recess that is not covered by the workpiece, a controlled shielding within the bending die can be performed by means of a shielding element of a shielding device that can bear incident radiation without disadvantageous changes, with the result that the radiation emitting from the bending die can be adjusted even more exactly to the dimensions of a workpiece. In order to be able to machine workpieces with different bending lengths with bending dies of this kind, the shielding is preferably effected by means of an adjustable shielding element of a shielding device. By this measure, a possible safety-related critical emission of beams next to the workpiece is further reduced. Because not every workpiece covers the entire length of the bending recess, because frequently its bending length is shorter than the length of the bending die or die arrangement, and an emission of high-energy radiation next to the workpiece should be avoided for job safety reasons, concerning the execution of the method it is advantageous if at least one adjustable shielding element for covering sections not covered by the workpiece is arranged at the bending die viewed in direction of the beams after the beam exit opening. Said shielding element can be embodied as a slider adjustable along the bending recess and, depending on the bending length of the workpiece, the part of the bending recess that is not covered by the workpiece is thus covered by the shielding element and thus at least a direct emission of radiation next to the workpiece can be avoided.

In particular, the shielding element can be adjustable in the direction of the bending length until it bears against the workpiece, with the result that for any bending length an optimal elimination of leakage radiation can be effected. The adjustment of the shielding element can be effected by any suitable adjustment drive, in particular a linear drive, for example by means of a pneumatic cylinder, with which a defined lateral pressing of the shielding element against the workpiece can be achieved. In this case, the workpiece can be particularly be positioned either at the right or left ending of a bending die by means of a fixed stop and the shielding element is approached to the workpiece from the respective other ending of the bending die by means of a actuator. A constructional easier alternative actuator for the shielding element can be formed of a friction drive.

Due to the fact that the workpiece during the bending deformation is deformed on the basis of a widely flat original state into the interior of the bending recess, it is advantageous if the shielding element is mounted in the interior of the bending adjustable in the tool base body or at the die arrangement, for example by springy or flexible mounting of the shielding element or the complete shielding device. The shielding element can thus keep bearing against or contacting the workpiece during the bending process and is, together with the workpiece, pressed into the bending recess by a bending punch. For this purpose, the shielding element or the complete shielding device can be pressed to the top face of the bending recess by means of a spring which is effective towards the outside and can be limited in its adjustability towards the outside by means of a guidance, i.e. it can be preloaded in an external initial state.

To ensure the effectivity of the shielding element, it is advantageous if the bearing of the shielding element against the edge of the workpiece is checked mechanically, electrically or optically, in particular contactless before the radiation is activated. For this purpose, a mechanical sensor device, for example in form of a key-switch, can be provided for example at the front side of the shielding element, a current flow in case of contact between shielding element and workpiece can be supervised or an optical supervision by means of camera and image evaluation can be effected. An optical supervision of the bearing can preferably be effected by the shielding element being such embodied that its ending facing away from the front side can be positioned below the workpiece and in this end section an optically ascertainable check mark is applied, that in case of a correct bearing of the shielding element against the workpiece is under the latter and it is possible to check by means of camera with image evaluation whether the check mark is still visible or invisible due to correct bearing of the shielding element against the workpiece.

In order to minimize the absorption of radiation at the shielding device or to recognize an excessive heating due to the absorbed radiation, the shielding element can have a surface with a reflective coating at its bottom side and/or a convex surface that diverges radiation and/or it can be equipped with a temperature control. Due to the reflective or diverging surface of the shielding element, it only absorbs a proportion of the radiation energy, whereas the remaining reflected proportion is distributed over the interior of the bending die, with the result that the arising of temperature peaks is largely avoided. Additionally, the shielding element can have a cooling device, for example in form of channels containing water.

A further improvement of safety for an operator being in the environment of the bending die is achieved if a focus of the radiation effected by a beam affecting arrangement in the bending die is positioned within the bending recess, with the result that emitting radiation outside the bending die extends diverging. Outside the bending recess and above the contact surface is thus no concentrated radiation and a possible endangering of an operator very quickly decreases corresponding to the increasing distance to the bending recess. The radiation is thus preferably guided to the beam exit opening by means of diverging lenses or convex mirrors or when using concentrating optical component parts like converging lenses or concave mirrors, a focus formed by them is so positioned that it is still within the bending recess. Because the radiation focused at the deformation zone is composed of several planar fanned beams, inevitable fluctuations of the radiation intensity along the deformation zone result that are compensated as best as possible by suitable overlapping of adjacent planar fanned beams. In this case, the region, where the radiation has the highest evenness of the radiation intensity along the deformation zone, can be positioned in a region of high levels of deformation, i.e. not in the same level as the contact face for the undeformed workpiece, but after a certain depth of impression of the bending punch. Thus, the deformation zone of a workpiece is most evenly irradiated and thus heated in the phase, when the highest stresses during the bending process occur, with the result that the best bending results can be achieved.

To be able to recognize an unexpected and excessive emission of radiation not hitting the workpiece, a further measure of safety could be, to measure or determine radiation emitting from the die arrangement and not being absorbed by the workpiece, i.e. a leakage radiation by means of a detection process. For this purpose, for example sensitive sensors for emitting radiation are arranged in the environment of the bending die or for example in the region of the upper press beam and a control device can evaluate an exceeding of predetermined limit values or activate an automatic switch-off of the radiation source. This measure is in particular advantageous regarding radiation with wavelengths that the human eye cannot detect.

In order to further reduce a possible endangering of an operator, the detection of leakage radiation can be effected before the heating of the workpiece by means of not dangerous test radiation with low energy density. For this purpose, the radiation source provided for heating can provide different test radiation sources or it is also possible that the radiation is such influenced as to only emit radiation with low energy density, for example by supplying diode laser bars with a lower voltage, with which only light of low energy density is emitted.

In order to be able to check the effectiveness of the controlled radiation production or radiation distribution and the quality of the local heating thus effected, in a further embodiment of the method, the temperature of at least one location, preferably of several locations of the deformation zone of the workpiece to be bent is recorded during the heating. This recording of the temperature can be effected tactile with touching sensor devices in the bending die or in the bending punch, but also contactless by means of a thermo-optical measurement method, for example by using a pyrometer or a thermal imaging camera. On the basis of this measurement of the heated deformation zone, a defect at the radiation source or at beam effecting topical component parts can be recognized before a bending process at a not sufficiently heated workpiece is made and the workpiece is thus probably destroyed because it can break during the bending process or the bending angle can exceed a certain tolerance due to too low but also too high temperatures. The evaluation of the measurement of the temperature and the taking of measurement required when it is discovered that the workpiece is not heated according to plan can preferably be effected by means of an electronic control device.

When using very high energy radiation or when a workpiece with breakthroughs is worked on, in spite of controlled discharge of beams out of the bending die in the environment of the die arrangement and the workpiece a high energy radiation can arise, with the result that it can furthermore be of advantage that the environment of the workpiece, in particular the area where an operating person stays, is protected against radiation by a shielding arrangement during the activation of the radiation. Such a shielding arrangement can for example be formed of a curtain being automatically brought into position that can reduce a distribution of harmful radiation, similar to the shielding at welding workstations.

The controlled local heating by radiation, which is led onto a workpiece through a beam exit opening, can be effected by not activating the radiation sources in sections of the length of the bending die not required, in case of arrangement of several radiation sources in the bending die. This can be effected by switching measures within the bending die but also by a control device arranged outside the bending die.

In order to be able to control the local heating of the workpiece to be bent better, it is of advantage if the power emitted by the radiation source and/or the exposure duration of the radiation onto the material and the geometric dimensions of the workpiece to be bent can be adjusted by means of a control device. The control device used therefore can also be used to control the bending press or it can in turn be formed of the control device of the radiation source.

In order to ensure a high quality of the local heating of the workpiece it is of advantage if the radiation power emitted onto the workpiece by the radiation sources is monitored by periodic or permanent measurements. For this purpose, sensors can be arranged in the bending die, circa in the region of the bending recess that can be used to measure the absolute value as well as the relative distribution of the radiation intensity. This can additionally be planned for the supervision of the temperature of the deformation zone, because, due to different material properties, in particular different coefficients of thermal conductivity and thermal capacity of the workpieces to be bent, also a supervision of the radiation power emitted by the die arrangement ensures the information concerning the heating process.

A advantageous embodiment of the method is that an air connection with a thereto connected air channel or flow path is provided at the bending die, through which scavenging air can be led to the region between the radiation generators or the beam affecting arrangement and the beam exit opening or the workpiece and the scavenging air discharges at another place. Thus, the parts of the die arrangement bordering the flow path, in particular the tool base body are cooled and furthermore a deposition of dust or any other contamination in the beam leading channels or at the optical elements within the die arrangement can be reduced. The leading of scavenging air can also be limited to the region of the bending recess.

Due to the fact that a workpiece being locally heated in the region of the deformation zone can considerably bend or distort and thus the position relative to the bending line can differ, it is of advantage if, during the heating by the radiation, the workpiece is fixed by means of an own retaining element or in particular by means of the bending punch in its position relative to the die arrangement.

In this case, the method can be advantageously be such embodied that the workpiece before the application of radiation by the bending punch, the workpiece is subject to a slight, in particular only elastic bending deformation and fixed in this position by the bending punch, not till then the heating by discharging radiation onto the bottom side of the workpiece is activated, and on expiry of a predetermined period of time beginning with the activation of the radiation, that can also be zero, or beginning when the workpiece in its deformation zone obtains a certain temperature, the deformation is continued, with the radiation continuing being activated until or short before the termination of the bending deformation. Thus, at first quasi a clamping if the workpiece for the purpose of fixing and stiffening the workpiece against unexpected deformation due to heat stresses is effected. The activation of the laser radiation that is at first time-delayed and follows when the punch movement is continued or interrupted and the thus resulting heating of the workpiece in the deformation zone increases the plastic deformability of the actual brittle workpiece and the bending process can be continued up to the area of high deformation levels and no cracks or breaks of the material occur. The punch movement can thus be performed without interruption but also with an interruption, within of which a certain level of temperature of the deformation zone is achieved. A temperature supervision used thereto can also ensure that the laser radiation is activated and effective, whereby undesired cold working can be avoided in an elegant way.

Another measure to avoid leakage radiation in the environment of the bending die or the die arrangement is, to embody the interfaces between the adjacent beam leading elements, in particular between bending dies abutting against one another or between an external radiation source and a bending die of a die arrangement optically dense. This can for example be effected by manufacturing the abutting front sides or joining areas of adjacent bending dies with a high fitting accuracy and thus minimizing the gaps and grooves between adjacent bending dies. Alternatively or additionally to this measure, such interfaces between elements of a die arrangement can provide additional covering elements or sealing elements.

Another improvement of the method can be achieved by measuring the temperature of the workpiece at the deformation zone during the heating by radiation and the measured value can be fed into an electronic control device, which blocks, unblocks, accelerates, decelerates a bending process depending on the measured temperature and/or increases, reduces or deactivates radiation performance by means of activation, deactivation or power regulation of the radiation sources in the die arrangement or the external radiation source. Thus, deficit bending due to an insufficiently heated workpiece, for example because of a defective radiation source or too short exposure duration of radiation or overheating of the workpiece, can be avoided to a large extent.

The objective of the invention is furthermore also achieved by a die arrangement, according to which for a controlled distributed generation of radiation, an arrangement of radiation sources, in particular diode laser bars, are fixed within the tool base body, which can optionally be activated or deactivated and are arranged at least approximately evenly along the longitudinal direction of the bending recess behind the beam exit opening in the tool base body. By a thus effected distributed generation of high energy radiation within the bending die, a safety-related critical usage of high-concentrated portioned beams is avoided, for which reason the necessary protective measures for an operator in the environment of such a bending die are considerably less extensive when a bending die of this kind is used. The usage of diode laser bars as radiation sources is especially advantageous for the local heating of sheet metal workpieces, because in this case energy densities are present, which can effect a sufficiently fast heating, but a destruction of the workpiece due to a too long exposure durations is hardly possible or serious injuries of the operator in case of unexpected radiation emission are less possible.

The objective of the invention is furthermore achieved by a die arrangement, according to which each tool base body has at least one beam entry opening with thereto following beam path in the interior of the bending die for introducing at least one high-energy concentrated radiation beam produced by a radiation source arranged outside the tool base body and in the tool base body of each bending die of the die arrangement, at least one beam affecting arrangement is arranged, which temporarily and locally stationary deflects and expands at least a part of the radiation beam and guides it through the beam exit opening to the area of the bearing surface of the workpiece. Because it is at single or several optical component party possible to distribute the radiation emitted by the radiation source into different sections of the beam exit opening or within the die arrangement and thus to be able to discharge the radiation out of the die arrangement adjusted to a workpiece and/or to be able to deflect portions of the radiation to other regions within the die arrangement, with the result that said radiation is absorbed within the bending die and does not leave it through the beam exit opening, an emission of radiation relevant to safety which does not hit the workpiece is avoided to a large extent in many use cases.

At their front sides, bending dies according to the invention or die arrangements can provide end elements closing interfaces or openings for transmitting radiation beams, of interfaces for connecting cooling water, current, or purge air.

A further embodiment, particularly advantageous regarding protection of workers, of a die arrangement according to the invention is that at least one adjustable shielding element for covering sections of the bending recess not covered by the workpiece is provided at the bending die between the beam exit opening and the contact surface.

By combining the before mentioned safety measures, the method according to the invention can such be created that a stay within the close-up range of the press maximally corresponds to an endangering of the operator according to laser class 1.

A die arrangement according to the invention can also be embodied in such a way that the tool base body comprises a die adaptor forming the contact surface and the bending recess and the die adaptor is exchangeable arranged at the remaining part of the tool base body containing the radiation sources or beam affecting arrangements. Thus, the tool base body can be adjusted to different bending tasks by exchanging the die adaptor, particularly the die width can be changed, with the result that the scope of application of such a die arrangement is considerably increased. Furthermore, a die arrangement of this kind, due to the built-in radiation sources or beam affecting arrangements being relatively expensive can be used more frequently and thus more economically advantageous.

For a better understanding the invention will be described in more detail by means of the following figures.

Figure 3:
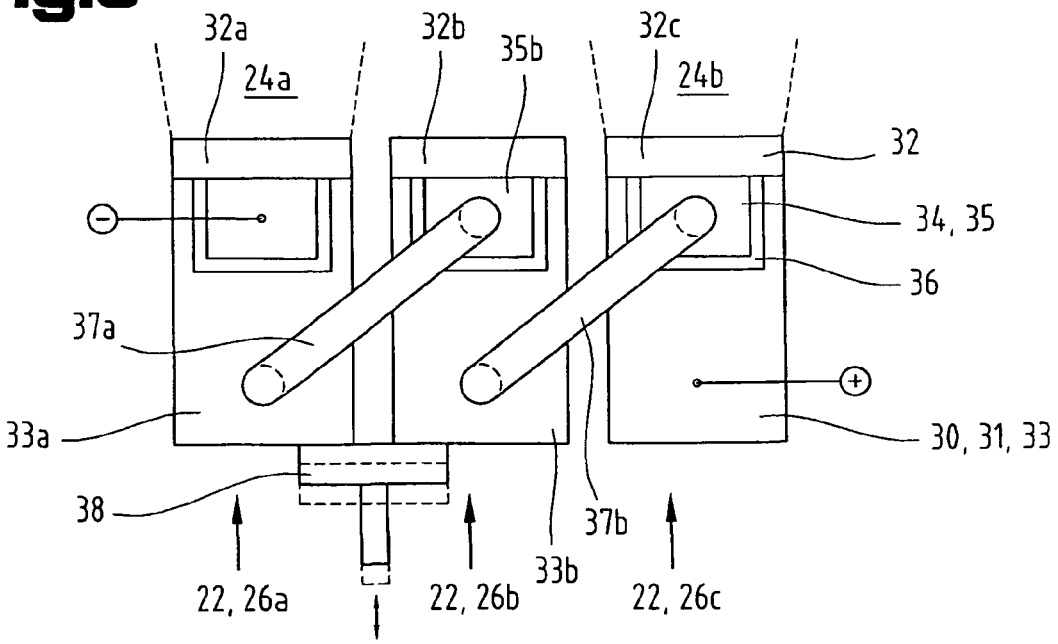
Figure 2:
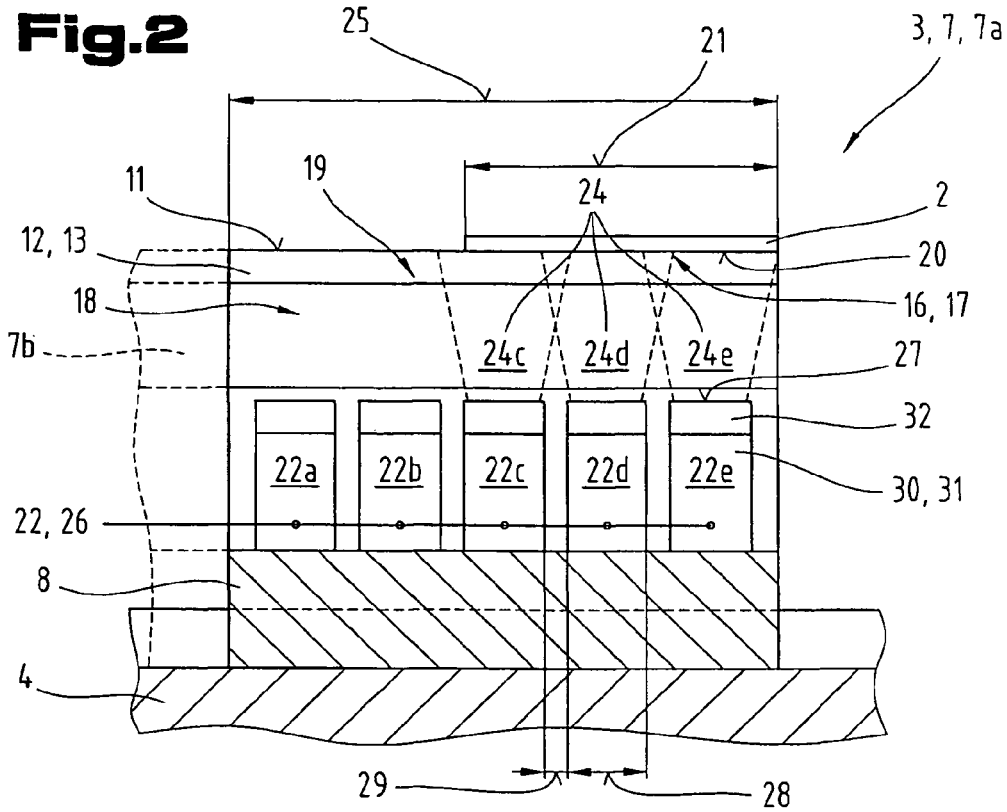
Figure 4:
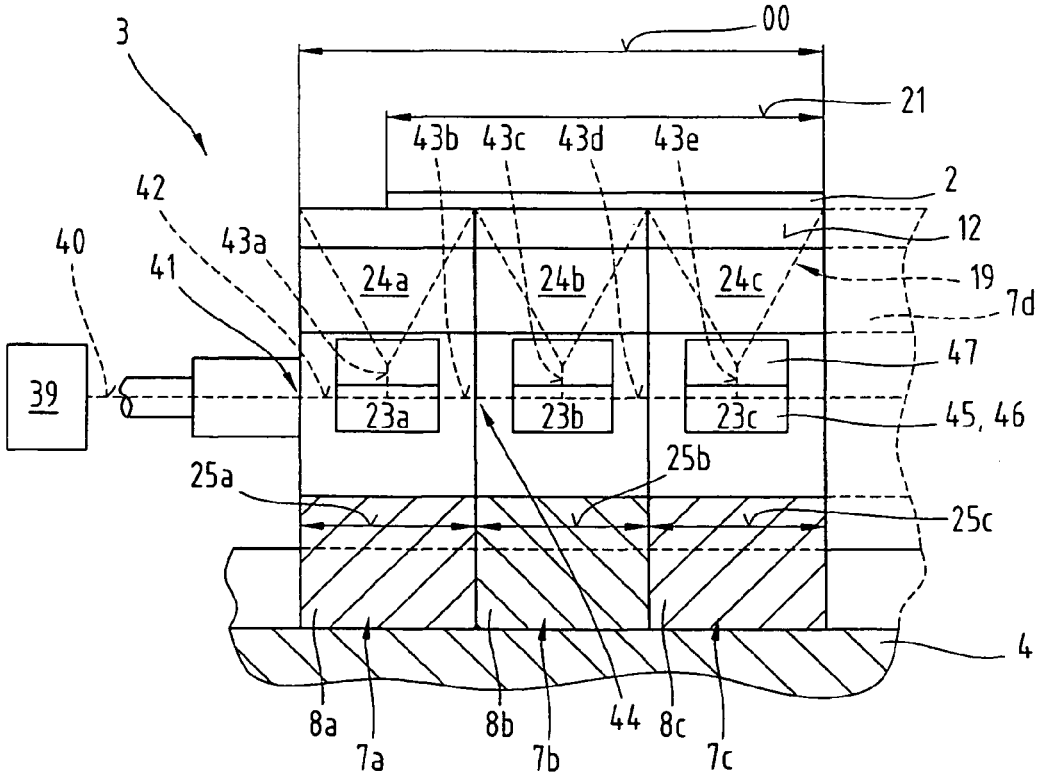
Figure 5:
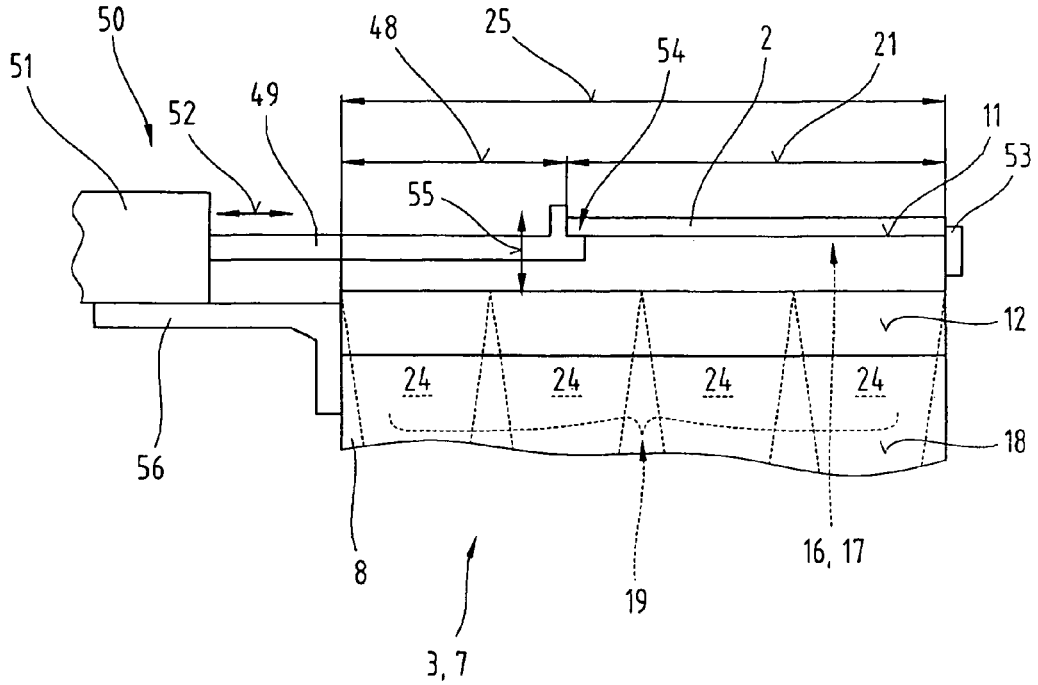
Figure 6:
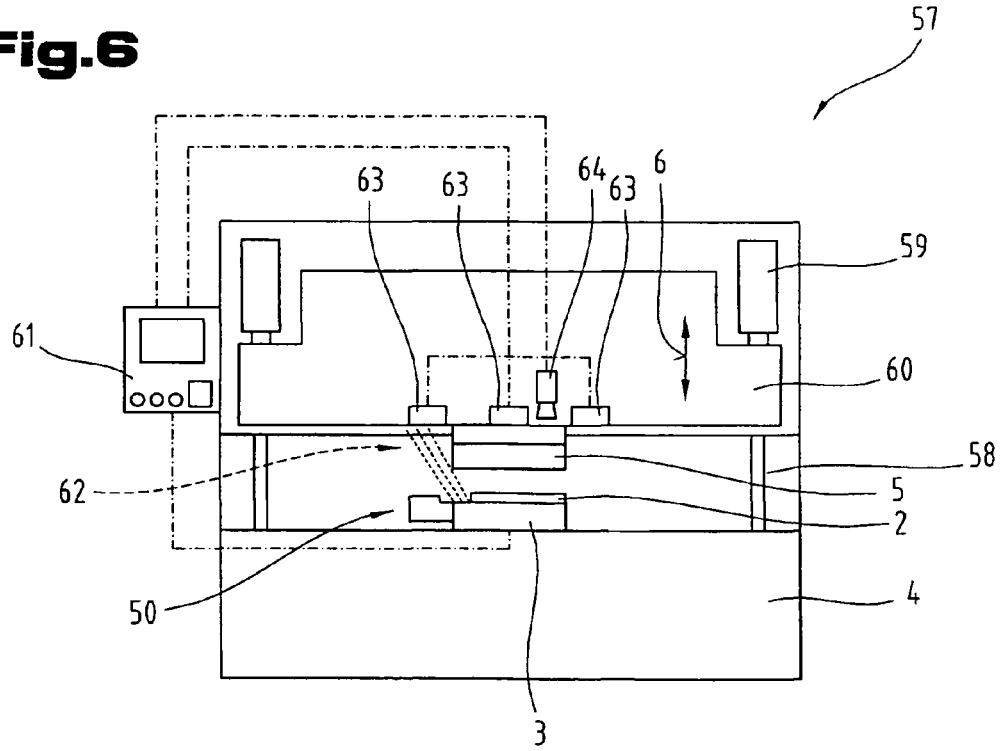
Figure 7:
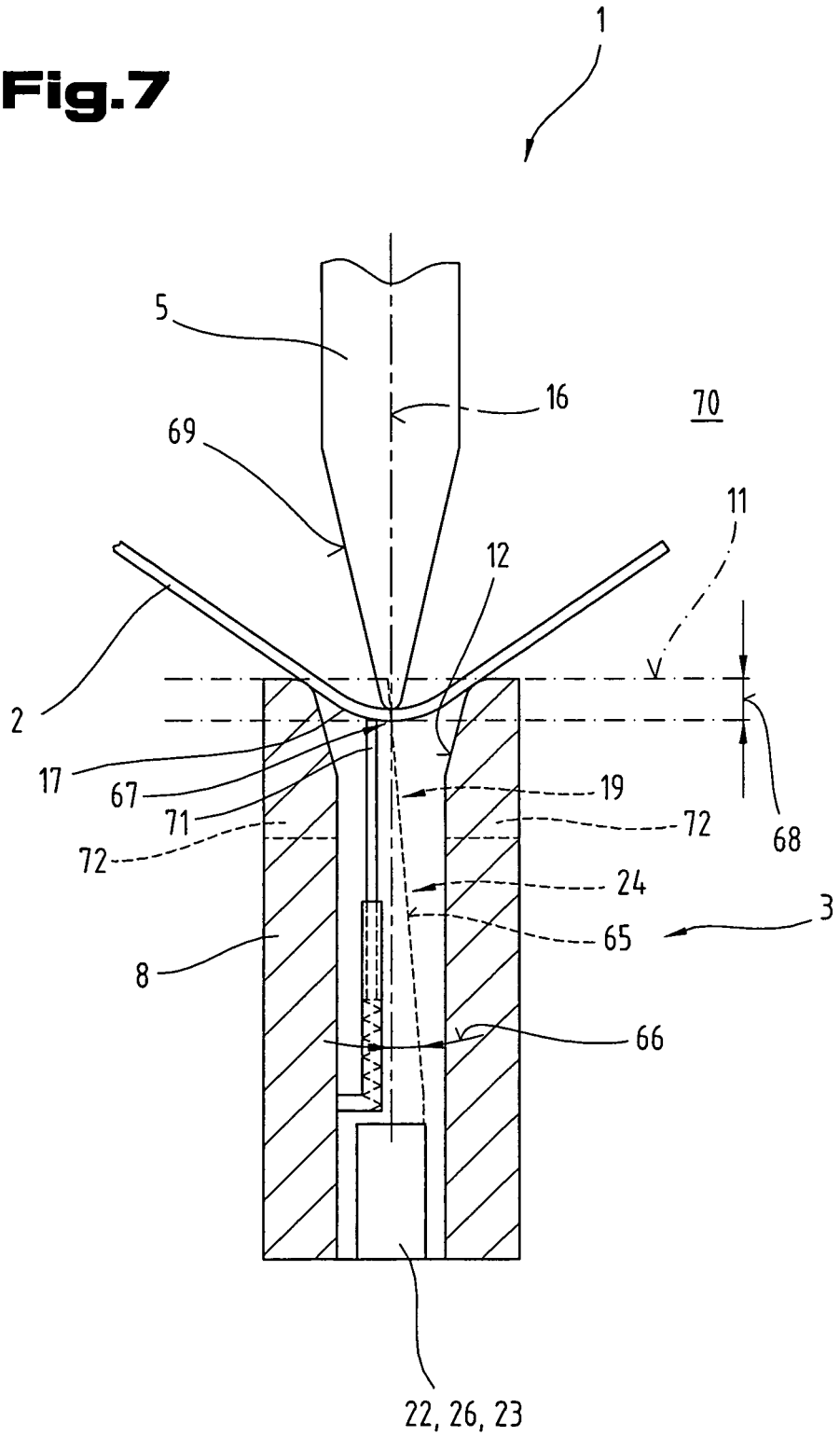

In a highly schematically simplified way:

FIG. 1 a cross-sectional view through a bending tool arrangement for deforming a workpiece by means of the method according to the invention comprising a bending die and a bending punch;

FIG. 2 a cut through a bending die along the line II-II in FIG. 1 with distributed generation of high-energy radiation by several radiation sources within a bending die;

FIG. 3 a possible form of embodiment of the electrical wiring of several radiation sources in a die arrangement;

FIG. 4 a cut through a die arrangement in FIG. 1 along line IV-IV where a radiation generated by an external radiation source is distributed by beam affecting arrangements in several bending dies stringed together;

FIG. 5 a partial cut through a die arrangement according to FIG. 2 or 3 with a shielding element;

FIG. 6 an example of a trimming press with a die arrangement according to the invention for performing the method according to the invention;

FIG. 7 a cut through a bending tool arrangement while the bending method according to the invention is performed with a further form of embodiment of a die arrangement.

First of all, it should be pointed out that in the variously described exemplary embodiments the same parts are given the same reference numerals and the same component names, whereby the disclosures contained throughout the entire description can be applied to the same parts with the same reference numerals and the same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described may be construed as independent inventive solutions or solutions proposed by the invention in their own right.

All value range specifications in the objective description should be taken as arbitrary ranges which encompass all subareas lying within these ranges, e.g. the specification 1 to 10 should be understood to encompass the full range starting from the bottom limit 1 and rising to the top limit 10, i.e. all subareas start with a bottom limit of 1 or more and end with a top limit of 10 or less, e.g. 1 to 1.7, or 3.2 to 8.1, or 5.5 to 10.

FIG. 1 shows a bending tool arrangement 1 that is applicable for bending a workpiece 2 by performing the method according to the invention or by applying a die arrangement 3 according to the invention. The bending tool arrangement 1 comprises at least one die arrangement 3 that is arranged at a sectional shown, fixed first press beam 4 or a pressing table of a bending press or trimming press and an only sectional shown bending punch 5 being arranged at an adjustable second press beam not shown. In order to perform a bending deformation, the bending punch and the second, not shown press beam are arranged in an adjustable way in the direction of adjustment 6. The die arrangement 3 comprises at least one bending die 7 with a tool base body 8 that outer dimensions essentially correspond to a conventional bending die. The die arrangement 3 or the at least one bending die 7 preferably has a connection profile 9, which is applicable for holding a standard tool holder 10 of a conventional press beam 4.

For bending a workpiece 2, the latter is borne against a contact surface 11 of the bending die 3 and, by means of the bending punch 5, pressed into a groove-like bending recess 12 within the contact surface 11, with the result that the workpiece 2 is subject to a permanent deformation when tensions that exceed a yield strength or a proportional limit of the material of the workpiece appear as a consequence of forming. In the exemplary embodiment shown in FIG. 1, the bending recess 12 is formed as a V-shaped groove 13 and the bending die 7 thus as a V-shaped die 14, but also differing forms of the bending recess 12 are possible, as long they are applicable to allow the so-called air bending that means, the bending of the workpiece 2 with bearing it along two lines of the die arrangement 3 or the bending die 7 and approximately line-shaped pressure by the bending punch 5 between these two contact lines. Thus, also bending recesses 12 with u-shaped or rectangular cross-sections are imaginable. The bending die 5 has a wedge-shaped cross-section, the wedge-angle of which approximately equals the angle of the V-shaped groove 13 and is at least approximately arranged within the symmetry plane of the bending recess 12. The bending method that can be performed with bending tool arrangements 1 of this kind is also referred to as trimming or can be performed as air bending or coining.

In the further description, the in FIG. 1 vertical symmetry plane of the bending punch 5 or the bending recess 12 is referred to as bending plane 15 and its intersection point with the contact surface 111 is referred to as bending line 16, with the bending plane 15 in the exemplary embodiments coinciding with a beam plane, within of which the high-energy radiation mainly extends. The bending line 16 generally extends approximately in the middle of a deformation zone 17 within of which the plastic deformation of the workpiece 2 is performed during the bending process.

Generically, with the method according to the invention, before or during the deformation a high-energy radiation 19 partly marked by a dashed line is, in the area of the deformation zone 17, guided through a beam exit opening 18 to the bottom side 20 of the workpiece 2 bearing against the contact surface 11, with the result that the workpiece 2 is locally heated and thus its mechanical-technological characteristics are changed in a way that the bending deformation can be effected with the necessary quality of the finished workpiece 2. The method according to the invention is preferably applied to brittle raw material, with which a reduction of the elastic limit or a proportional limit can be achieved by heating the material and the workpiece 2 can thus bear the stresses in low scopes necessary for plastic deformation without exceeding the breaking points.

According to the invention, the high-energy radiation 19 used for the local heating can be approximately adjusted to the bending length 21 (see FIG. 2 or FIG. 4) that means to the length of the deformation zone 17 to be heated of the workpiece 2 to bent by producing the radiation 19, guided through the bending recess 12 of the die arrangement 3 onto the workpiece 2, by means of a number of radiation sources 22, which are optionally activatable and arranged along the bending recess 12 within the die arrangement 3 or within the die arrangement 3, a high-energy concentrated radiation beam introduced into the die arrangement 3 is transformed to be radiation 19, by a number of beam affecting arrangements 23 arranged within the die arrangement 3 that each temporarily and locally stationary deflect a part of the radiation beam, expand it to planar fanned beams 24 and guide it through the beam exit opening 18 to the workpiece 2 in the region of the deformation zone 17. Additionally, by stringing together a number of bending dies 7, a multi-piece die arrangement 3 with a variable length can be formed. The simplest form of the beam exit opening 18 is a slot, extending across the entire die length, from the radiation sources 22 or the beam affecting arrangements 23 to the bending recess 12, but it can also be arranged in an interrupted way, for example by providing local spacer elements between the arms of the essentially u-shaped cross-section of the tool base body 8.

By this embodiment or similar embodiments of the die arrangement 3, the radiation 19 of both method variants is guided to the workpiece 2 in form of planar fanned beams 24, arranged along the bending recess 12, through the beam exit opening 18 in the tool base body 8, approximately in the bending plane 15 or slightly tilted to it and by a predefined number of planar fanned beams 24, an adjustment to the bending length of the workpiece 2 can be effected. The fact that said planar fanned beams 24 are generated within the die arrangement 3 allows the performance of this method with conventional bending machines or trimming presses, because the die arrangement 3 used thereto can be identical with conventional bending presses and no generation of radiation 19, for example in the interior of a special press beam with a corresponding cavity is required.

FIG. 2 shows a cut according to line II-II in FIG. 1 through a first possible variant of embodiment of a die arrangement 3 for performing the bending method according to the invention. With this first form of embodiment of a die arrangement 3, the latter comprises for example only one bending die 7, the die length 25 of which is larger than the bending length 12 of a workpiece 2 to be bent with it. If the bending length 21 was larger than the die length 25, by adding of a second bending die **7*b* of this kind to a first bending die 7*a* of this kind, a total length of the die arrangement 3 could be realized that exceeds the bending length 21 of the workpiece 2 and thus allows a bending of larger workpieces 2**.

In the tool base body 8, preferably providing outer dimensions corresponding to conventional bending dies, in an inner cavity, thus within the die arrangement 3, a number of radiation sources 22 is located, in this case the radiation sources **22*a*, 22*b*, 22*c*, 22*d*, 22*e*, that are essentially arranged evenly along the bending recess 12 in the interior of the tool base body 8 and that can emit the laser radiation 19 through the beam exit opening 18 to the bending recess 12 and thus also to the bottom side 20 of the workpiece 2. The radiation sources 22*a* to 22*e* are preferably made of diode laser bars 26 that have beam exit areas 27 which are elongate and orientated approximately parallel to the bending line 16 each. The longitudinal measurement of the beam exit area 27 in this case at least approximately corresponds to the bar width 28 that, together with the distance 29 between two adjacent diode laser bars 26 and the number of built-in diode laser bars 26, defines the possible die length 25. In this case, the diode laser bars 26 can be fixed singly to the tool base body 8, but also combined to be a diode laser insert that makes up a connected assembly group and can be fixed to the tool base body 7** in an easily exchangeable way.

Diode laser bars 26 of this kind comprise electrically and optically combined groups of laser diodes that emit laser radiation and, as shown in FIG. 2, are arranged at an ending facing the workpiece 2 of such a strip-shaped diode laser bar 26 and essentially emit their laser radiation in longitudinal direction—in FIG. 2 in upward direction—of such a strip. The radiation performance of such a diode laser bar 26 is made up of the sum of the individual performances of the laser diodes that are mounted electrically parallel and essentially on a cooling member or a heat sink making up the base body of the strip-shaped diode laser bar 26. Such arrangements of laser diodes are also referred to as edge-emitting broad area diode laser and can be used either with the mode of operation continuous wave, where the laser diode continuously and without interruption emits a laser beam or the mode of operation pulsed, where timely short laser beam impulses are emitted. The diode laser bars 26 for example comprise approximately 45 single emitters each and have an optical output power in a range of 150 Watt to 250 Watt each and also even higher performances per diode laser bar 20 are possible due to special construction forms.

The bar width is in this case for example 11 mm and the area emitting the laser radiation has a emitting width of for example 10 mm. Thus, when using such diode laser bars 20 in case of short distances between the adjacent diode laser bars 20, eight suchlike diode laser bars 20 can be inserted into a bending die 7 with a die length 25 of for example 100 mm. The wave length of the emitted laser radiation depends on the kind of the inserted diode laser bars 26, whereby the laser radiation is for example 940 nanometers, but depending on the doping of the semiconductors of the laser diode also other ranges of wave lengths are possible, as there are 635 to 700 nanometers; 780 to 1000 nanometers and 1250 to 1700 nanometers, whereby in this case mainly infrared radiation, that means areas beyond the visible spectrum, are concerned.

Each diode laser bar 26 has a beam exit area 27 pointing towards the beam exit opening 27. At said beam exit area 27 all laser beams produced by the single laser diodes of a diode laser bar 26 exit generally approximately in parallel direction and build a planar fanned beam 24 due to the even arrangement of the laser diodes. Said planar fanned beams 24 consist of a row of laser beams extending at least approximately parallel to each other. Because the single diode laser bars 26 are mounted along the bending recess 12 behind the beam exit opening 18, in this case thus below the slot-shaped beam exit opening 18 in a common plane, also the planar fanned beams 24 emitted by the single diode laser bars 26 are located at least approximately in one plane that can also be referred to as beam plane. In the in FIG. 2 displayed exemplary embodiment, this plane is substantially identical with the bending plane 15 (see also FIG. 1), but can also take an angle to it as long as sufficient radiation power can be applied in the area of the bending line 16 or the deformation zone 17 at the workpiece 2 before and/or during the deformation process.

A sequence of several laser diode laser bars 26 with planar fanned beams 24 being in one plane and approximately parallel to each other to be a diode laser insert is also called horizontal stack Because the laser beams emitted by the laser diodes do not have the form of a geometrically correct line (z-direction) but, due to the generally asymmetric form of the active emitter region, can have different beam widening in both the x-direction and in the y-direction, and additionally, the output beam can be astigmatic, with the result that the beam waists regarding the x-direction and the y-direction are located at different positions, an inevitable beam widening is produced, which can be counteracted by appropriate optical component parts. It is nevertheless also possible to use diode laser bars 26 without optical elements affecting the beam quality.

In FIG. 2, this widening of the single beams by planar fanned beams 24 widening/expanding in direction of propagation is adumbrated, whereby a beam widening within a beam plane can be advantageous for the purposes of the heating of a workpiece, because the evenness of the intensity of the total radiation hitting the workpiece can be increased due to applicable overlapping of such planar fanned beams 24. Furthermore, the usage of diverging laser beams or planar fanned beams 24 is also advantageous with respect to the job safety because laser radiation emitting from the surrounding of the bending die 3, that can also be referred to as leakage radiation, quickly loses intensity according to increasing distance and thus the potential risk of danger for an operator working in this area also decreases quickly.

This is particularly of advantage if workpieces with different bending lengths 21 are to be bent on the same die arrangement 3, because in this case, there frequently are sections of the bending recess 12 that are not covered by the workpiece 2.

The widening of the planar fanned beams 24 within the beam plane, here the bending plane 15, adumbrated in FIG. 2, also serves for the evenness of the intensity of the total radiation at the workpiece 2, because in the interspaces between two adjacent beam exit areas 27 of adjacent diode laser bars 26 no radiation power is emitted and thus, in case of strict parallel distribution of the beams, areas of the deformation zone 17 above said interspaces are probably less heated what can have an negative affect on the bending quality. In order to achieve the largest possible power density per unit of length at the bending line 16 and thus to minimize the necessary heating-up periods, it is furthermore of advantage if the beam exit area 27 of the diode laser bars 26 extends at least approximately over the entire bar width 28 and if the smallest possible interspaces or distances 29 are provided between adjacent diode laser bars 26. The diode laser bars 26 thus follow as closely as possible behind the beam exit opening 18 in longitudinal direction of the bending recess 12 and they are arranged as evenly as possible.

The exemplary embodiment in FIG. 2 shows a die arrangement 3 with five diode laser bars 26. The individual diode laser bars 26 are mounted to a corresponding fixing surface of the tool base body 8 or a diode laser insert and at the fixing surface projecting elements or bars can be embodied that facilitate an exact positioning of the diode laser bars 26 with even distances essentially corresponding to the width of the bars.

A diode laser bar 26 useable for this form of embodiment of a bending die 7 comprises for example a strip-shaped cooling element 30 that is in particular formed as a microchannel cooler 31. Such a microchannel cooler 31 consists of a layered arrangement of well heat conducting metal sheets, in which a number of channels that can be flown through by a coolant and thus allow a high heat release out of the diode laser bars 26, are embodied. This is necessary because the laser diodes arrangement 32 arranged on the cooling element 30 or the microchannel cooler 31 cannot completely transform the electrical energy fed into high-energy radiation 19 but always produces a certain share of thermal losses that have to be removed away from the laser diodes arrangement 32 to avoid an overheating of the semiconductor elements contained therein. The feeding of electrical energy to a diode laser bar 26 or the laser diodes arrangement 32 arranged thereon is effected in form of direct current or pulsing rectified alternating current. In the exemplary embodiment, the cooling element 30 acts as a positive terminal and the negative terminal is embodied in form of a contact plate put on the cooling element 30.

The optional activation of the radiation sources 22*a* to 22*e* according to the invention is effected by a circuit measure or switches of any type which can be used to connect the respective radiation sources 22, in this exemplary embodiment thus the diode laser bars 26 with the power supply or disconnect them from the latter. In the shown exemplary embodiment according to FIG. 2, the two radiation sources 22*a* and 22*b* on the left are deactivated, that means not connected with the power supply and only the radiation sources 22*c* to 22*e* below the workpiece 2 are activated and locally heat the deformation zone 17 of the workpiece 2 with the emitted planar fanned beams 24*c*, 24*d*, and 24*e*. The individual planar fanned beams 24*c*, 24*d* and 24*e* spread within the common beam plane and overlap one another in their edge regions, with the result that the radiation intensities of two adjacent planar fanned beams 24 are added in these edge regions and thus a radiation intensity declining from the middle of the planar fanned beam 24 to its edge region is compensated because also the total radiation intensity in the interspaces above two adjacent radiation sources 22 has a sufficient level due to the overlapping of the edge regions of two adjacent planar fanned beams 24. Over the entire bending length 21 of a workpiece 2, thus, high energy radiation 19 in sufficiently high or at least approximately even intensity can be introduced into the deformation zone 17 of a workpiece 2 by activating the required number or the radiation sources below 22.

This advantageous overlapping of adjacent planar fanned beams 24 is also advantageously applicable to the planar fanned beams produced with help of beam affecting arrangements 23.

A possibility to connect individual radiation sources 22 with the power supply or to disconnect it from the latter is, to connect adjacent diode laser bars 26 in series and not to conduct the current through the laser diode arrangement 32 in case of deactivating individual diode laser bars 26, but to pass the current directly from one pole to the corresponding pole of an adjacent diode laser bar 26 by means of contact elements similar to a bypass.

Such a circuit of diode laser bars 26 is simplified and schematically shown in FIG. 3. FIG. 3 shows three diode laser bars 26*a*, 26*b*, 26 connected in series with laser diodes arrangements 32*a*, 32*b* and 32*c*. Each radiation source 22 in form of a diode laser bar 26 comprises a cooling element 30, in this case for example in form of a microchannel cooler 31, acting as a positive terminal 33 for the laser diodes arrangement 32 and a contact plate 34 that is also connected with the laser diodes arrangement 32 and acts as a negative terminal 35. The positive terminal 33 conductively connected with the laser diodes arrangement 32 and the negative terminal 35, also conductively connected with the laser diodes arrangement 32 are separated in a galvanic way, for example by means of an insulation bed 36 as adumbrated in FIG. 3.

The series connection of adjacent diode laser bars 26 is effected via electrically well conductive connection elements 37 with a large diameter that are for example formed of a copper alloy with a low electrical resistance. Thus, the connection element 37*a* for example connects the positive terminal 33*a* of the diode laser bar 26*a* with the negative terminal 35*b* of the diode laser bar 26*b*, with the result that a current flow from the first diode laser bar 26 to the second diode laser bar 26*b* is possible. Likewise, the current is transmitted via from the second diode laser bar 26*b* to the third diode laser bar 26*c* via the connection element 37*c* in the following. Each laser diodes arrangement 32, which is flown through by current, emits a planar fanned beam 26. That means that in order to deactivate the emission of planar fanned beams 24 at individual radiation sources 22 in case of such a series connection of diode laser bars 26 or general radiation sources 22, it has to be achieved that the transmission of the current to the next diode laser bar 26 is not effected via the laser diodes arrangement 32 to be deactivated, but vie a contact element 38 that can also be referred to as bypassing element.

To simplify matters, only one contact element 38 forming an electrical connection between the positive terminal 33*a* of the first diode laser bar 26*a* and the positive terminal 33*b* of the second diode laser bar 26*b* shown in a contact position in continuous lines. In this contact position, only very little current flows via the contact element 37*a* through the laser diodes arrangement 32*b*, for which reason the latter is deactivated in the contact position of the contact element 38 and does not emit planar fanned beams 24. In the neutral position of the contact element 38 shown with dashed lines no direct bypassing between the diode laser bars 26*a* and 26*b* is effected, wherefore the laser diodes arrangement 32*b* is flown through by current and emits a planar fanned beam 24.

The contact element 38 can of course have different shapes and must only be applicable for transmitting considerable currents of more than 200 ampere without being damaged. Differing from the arrangement shown in FIG. 3 it is furthermore possible to such arrange or form the contact element 38 that a direct contact is for example created between positive terminal 33*a* and connection element 37*b*, between connection element 37*a* and connection element 37*b* or between connection element 37*a* and positive terminal 33*b*. Also a contacting of the negative terminals 34 can come into consideration. The contact element 38 thus acts as a bypassing element for the supply current bypassing laser diodes arrangements 32 to be deactivated.

The contact element or the contact elements 38 can particularly be adjusted between neutral and contact position by means of an adjustment device not shown, for example by piezo actuators, with the result that the optional activation and deactivation of the respective laser diodes arrangements 32 and thus the radiation sources 22 in form of diode laser bars 26 can be effected. The controlling of the individual contact elements 38 can in particular be effected by means of a control device, with the control device can be provided for the control of the bending machine or the trimming press at the same time.

In FIG. 4, a cut according to line IV-IV in FIG. 1 through a die arrangement 3 according to the invention is shown, which can be used for bending workpieces 2 according to the second variant of the method according to the invention and that in the exemplary embodiment shown is formed of three bending dies 7*a*, 7*b* and 7*c* stringed together. With this die arrangement 3, a concentrated radiation beam 40, emitted from an external radiation source 39 arranged outside the die arrangement 3 is introduced via a beam entry opening 41 into the first bending die 7*a* or into the tool base body of which and led along a beam path 42 in the interior of the die arrangement 3 through all bending dies 7*a*, 7*b* and 7*c*. In the first bending die 7*a*, the radiation beam 40 is split up into a first radiation beam portion 43 a and a second radiation beam portion 43*b* by means of a first beam affecting arrangement 23*a*. The first radiation beam portion 43*a* is deflected by means of the beam affecting arrangement 23*a*, deformed to be a planar fanned beam 24*a* and guided to the workpiece 2, whereas the second radiation beam portion 43*b* leaves the tool base body 8*a* of the first bending die 7*a* via a beam transfer opening 44 and is directly guided through a thereto adjacent beam entry opening 41 of the second bending die 7*b* into the tool base body 8*b* of the latter where it also is split up or divided in two radiation beam portions 43*c* and 43*d* by means of the beam affecting arrangement 32*b* of the second bending die 7*b*. In this case, the radiation beam portion 43*c* is deflected, formed to be a planar fanned beam 24*b* and, above the second bending die 7*b*, also guided to the workpiece. The radiation beam portion 43*d* is transmitted via the beam affecting arrangement 23*b* to the next bending die 7*c*, where it is completely deflected by the beam affecting arrangement 23*c*, spread apart to be a planar fanned beam 24*c* and guided to the workpiece 2 above the bending recess 12 of the third bending die 7*c*.

As adumbrated by dashed lines in FIG. 4, the die arrangement 3 can be extendable by at least one further subsequent bending die 7*d* and in such an embodiment of a die arrangement 3, the beam affecting arrangements 23*a*, 23*b* and 23*c* comprise at least one beam splitter element 45, one beam deflector 46 and one beam forming element 47 each, that decouple a first radiation beam portion 43*a* or 43*b* or 43*c* each, deflect it to the workpiece 2 and deform it to be a planar beam 24 and transmit a second radiation beam portion 43*b* or 43*d* along the beam path 42 via the beam transfer opening 44 to the next bending die 7*a* or 7*c* or 7*d*. In this case, the maximum length of a die arrangement 3 of this kind is limited by the total performance of the introduced radiation beam 40 and the beam portion performance required per bending die 7 to ensure a sufficient heating of the section above the workpiece 2.

The last bending die 7 of such a die arrangement 3 made of several bending dies 7 stringed together with beam affecting arrangement 23 can either comprise a beam affecting arrangement 23 that completely deflects the radiation beam portion 43 introduced from the preceding bending die 7 into the direction of the workpiece and does not decouple any other radiation beam portion 43 or, if a radiation beam portion 43 is also transmitted by the last bending die 7 with a beam affecting arrangement 23, an end element is to be provided that can absorb this last transmitted radiation beam portion 43 without any negative effects. In particular, the end element can be formed as a massive member of metal, which leads the last radiation beam portion not guided to the workpiece into its interior where it is at least approximately completely absorbed after multiple reflections within its interior.

The radiation beam portions 43*a*, 43*c*, 43*e*, decoupled from the radiation beam 40 and deflected or expanded into the direction of the workpiece 2, are deformed to planar fanned beams 24 by means of beam forming elements 47 that are also parts of the beam affecting arrangement 23. In the simplest case, the beam affecting arrangement 23 can also be formed of one individual optical element that acts as a beam splitter element 45, beam deflector 46 and beam forming element 47 at the same time.

In order to achieve a high evenness of the beam distribution and to be able to more easily influence the latter for better adjusting it to the workpiece 2, it is nevertheless advantageous if the functions beam splitting and beam forming are performed by a respective own optical element. The beam splitter element 45 can for example by formed of a semipermeable plane mirror, a prism or another reflective and beam splitting surface with an appropriate adjustment, whereas the beam forming element 47 can be formed of a lens, a convex mirror or a concave mirror and for fanning out to achieve a plane planar fanned beam 24, preferably cylindrical optical elements are used that are curved in only one direction and do not have any or a comparably slight curvature perpendicular to this direction. Alternatively, the fanning out of radiation can also be effected by using Powell lenses.

The beam splitter element 45 for example comprises a beam splitting plate, a polarization filter, a beam splitting cube, an FTIR beam splitter or optical elements that make use of photo-elastic or electro-optical effects. The effect of the beam splitting can in this case be achieved by optical active minerals, like for example with polarization filters or by beam splitter layers, like for example with a beam splitting cube, which achieve a distribution of the intensity of the hitting radiation beam. Such intensity beam splitters can separate beams of light with a wavelength but also polychromatic beams of light with a transmitting and a reflective portion and different diversion ratios are possible. Beam splitter layers can be formed of metallic layers or dielectric multilayers and by using polarization effects, the dielectric multilayers are well applicable for the method according to the invention.

Beam splitter plates useable for the method are made of plano-parallel plates of glass, quartz or a uniaxial crystal with a dielectric or metallic coating. Due to the thickness of the beam splitter plates, the transmitting beam experiences a slight beam displacement.

Beam splitter cubes are made of two 90-degree prisms that are cemented at their hypotenuses and the beam splitting coating is added to one hypotenuse and a transmitting beam does not experience a beam displacement.

FTIR beam splitters work according to the principle "Frustrated Total Internal Reflection" utilizing reflection and absorption effects at beam splitter cubes with an air gap between two 90-degree prisms and theses forms of beam splitters are well applicable to effect an adjustable beam distribution by adjusting the air gap, for example by means of piezo actuators that can adjust the prisms relative to one another and thus modify the air gap or by direct forming the prisms of optical translucent piezo-electrical material, for example LiNbO3, that can be influenced regarding its dimensions by applying voltage.

FIG. 4 shows the adjustment of the radiation 19 to the bending length 21 of a workpiece 2 by stringing together three bending dies 7*a*, 7*b*, 7*c*, with the result that the bending length 25 of the total die arrangement 3 results from the sum of the die lengths 25*a*, 25*b*, 25*c*. In this case it is simplified assumed that the total die length 25 of an individual bending die 7 can be used by a planar fanned beam 24 with a width corresponding to the bending process. In case, the bending length 21 of a workpiece 2 maximally corresponds to the die length 25 of an individual bending die 7, the die arrangement 3 can also be formed of one single bending die 7.

FIG. 5 shows a partial cut through a die arrangement 3, for example according to the embodiments in FIG. 2 or FIG. 4 or similar embodiment, with a measure for increasing the job safety in the environment of a die arrangement 3 according to the invention, that can also be applied when single bending dies 7 are used.

Because the bending length 21 of the workpiece 2 to be bent does not correspond to the total die length 25 of a die arrangement 3 or the total width of planar fanned beams 24 emitted by activated radiation sources in most cases, in a section 48 of the bending recess 12 not covered by the workpiece 2, high-energy radiation would discharge, having an radiation intensity that probably effects damages on the health of an operator in the environment of the bending tool arrangement 1. According to the embodiment of a die arrangement 3 shown, or a bending die 7, such a section 48 is covered by means of a shielding element 49 of a shielding device 50, with the result that the high-energy radiation 19 is prevented to discharge from the die arrangement 3 past the workpiece 2. In this case, the radiation emitting into the bending recess 12 through the beam exit opening 18 is at least partially absorbed by the shielding element 49 or reflected back into the interior of the bending die 7. The bottom side of the shielding elewent 49 can additionally have a deflecting or diverging surface, with the result that the intensity of the reflected radiation keeps decreasing and is spread over larger areas of the interior of the die.

For adjusting to different lengths of the bending lines 16 according to the respective dimension or bending line 16 of a workpiece 2, the shielding element 49 can advantageously be adjustable into the direction of the arrow 52 by means of an adjustment device 50. Such a shielding element 49 may additionally be provided at the right ending of a die arrangement 3 in FIG. 5 or a single bending die 7, but it is easier to construct if a workpiece 2 to be bent is always positioned at a fixed stop 53 and an approximation of a shielding element 49 is only required from one side.

The bearing of the shielding element 49 against the workpiece 2 to be bent can be ensured by approximating it to the workpiece 2 with a certain additional force and additionally, also a mechanic, electric or optical query of the contacting of the workpiece and thus a complete shielding of the section 48 can be ensured. This can be effected by providing the shielding element 49 at its ending facing the workpiece 2 at its top face with a check mark 54, which is supervised by an optical sensor, not shown, mounted above the die arrangement 3 or by a camera with connected image recognition. When the check mark 54 at the shielding element 49 is moved below the edge of the workpiece 2, it cannot be caught by the sensor, what means that the shielding element 49 bears against the workpiece. In this case, the end section with the check mark 49 has a notch in the area of the bending line 16 to allow that it can also be irradiated by the high-energy radiation at the edge of the workpiece 2. Furthermore, in this form of embodiment, the shielding element 49 or the entire shielding device 50 can be spring- or flexibly mounted into the direction of the double arrow 55, with the result that the shielding element 49 and the workpiece can together be pressed into the interior of the bending recess 12 when am bending process is performed and the bending process is not interfered thus.

As shown in FIG. 5, the shielding device 50 can be directly fixed to the die arrangement 3 by means of a retaining element 56.

FIG. 6 schematically and highly simplified shows a bending press 57, in particular a trimming press of conventional type, which can be used to perform the method according to the invention for bending a workpiece 2 by using the die arrangement 3 according to the invention. The bending machine 57 comprises a fixed frame 58, for example with C-racks, where the lower fixed press beam 4 is arranged at and furthermore an upper press beam 60 for performing a bending process is mounted in an adjustable way by means of linear adjustment drives 59, for example in the form of hydraulic cylinders, and appropriate guiding means. In this case, the die arrangement 3 according to the invention is arranged at the lower, fixed press beam 4 and the bending punch 5 cooperating therewith is mounted to the upper, adjustable press beam 60. The bending press 57 is controlled by means of a control device 61, with the latter being able to control particularly also the process steps connected to the method according to the invention or to the die arrangement 3 according to the invention. This includes for example the control, supply, activation, power control, or deactivation of the radiation sources 22 or 39 for generating the planar fanned beams 24 to heat a workpiece 2 in the region of its deformation zone 17 before/or during the performance of a bending process.

According to the invention, the radiation 19 can be partially adjusted to the workpiece 2 to be bent by the embodiment of the bending dies. As already described, a discharge of radiation that could harm a person in the surrounding of the bending press 57 is avoided best possibly, for example by using the described shielding device 50. In order to continue to minimize a possible endangering of a person in the area of a bending press 57 by high-energy radiation 19 it is advantageous if a leakage radiation 62 that unexpectedly discharges from the die arrangement and is not absorbed by the workpiece 2 can be determined or measured in the region of the bending tool arrangement 1 by means of appropriate sensor devices 63 and in case, an inadmissible strong leakage radiation 62 is present, the control device 61 effects a deactivation of the high energy radiation 19. By using such a detection procedure, radiation that is dangerous for a person in the surrounding of the die arrangement 3 can be directly detected and deactivated.

This detection procedure for leakage radiation 62 can particularly also be performed with a harmless test radiation with a low energy density, for example with light in the visible range, that is generated by appropriate elements within the die arrangement 3. Such a test radiation could also be generated by impinging the radiation sources 22 in the form of diode laser bars 26 with only low supply current, with the result that only low-energy radiation, similar to light emitting diodes, is emitted.

In order to optimize the bending process, it can additionally be provided that in the deformation zone 17 of a workpiece 2 one or several measurements of temperature before and during the deformation process, in order to ensure that the bending process is performed at sufficient heating of the workpiece 2. The value of a temperature measurement can for example be fed into the control device 61 that, based on the value measured, can effect an activation, deactivation or power control of the radiation sources 22, 39 or can block, release, effect, accelerate or decelerate a bending process by influencing the linear adjustment drive 59. The temperature measurement is in this case effected by appropriate measurement methods, for example contactless or by contact measurement of temperature of the deformation zone 17. As an example for contactless measurement measures, FIG. 6 shows the usage of a camera 64 in the form of a thermal imaging camera that is connected to the control device 61. Preprogrammed bending processes, also containing the radiation heating requirements regarding the specific workpieces, can be stored in the control device 61. Thus, additionally to the actual bending process, appropriate heating processes for different kinds of workpieces can be predetermined and carried out automatically.

FIG. 7 shows a cut through a bending tool arrangement 1 during the performance of the bending method according to the invention. The radiation 19 heating the deformation zone 17 of the workpiece 2 is in this case generated by a radiation source 22, for example in form of a diode laser bar 26, in the interior of the die arrangement 3 and is guided to the workpiece 2 in the form of one or several planar fanned beam(s) 24. In this exemplary embodiment according to FIG. 7, the beam plane 65, where essentially are the planar fanned beams 24, is not exactly situated in the bending plane 16, but between the beam plane 65 and the bending plane 16 in an angle of inclination 66 that is preferably between 2 and 15°. Due to the inclination between the two planes, a cutting line 67 between the bending plane 16 and the beam plane 65 results, preferably being situated within the bending recess 12 that means below the contact surface 11. This results in a depth offset 68, around which the cutting line 67 below the contact surface 11 is located and only when the bottom side of the workpiece 2 is in this position, exactly the middle of the deformation zone 17 is irradiated, whereas the beam plane 65 hits the deformation zone 17 of the workpiece at the side of the bending line 16 in case of positions of the workpiece 2 below or above the cutting line 67.

With the sketched orientation of the beam plane 65 and when the top of the punch 5 is above the contact surface 11, it is ensured that radiation emitting from the die arrangement 3 and not hitting the workpiece 2, hits the left face 69 of the bending punch 5 shown and is mainly deflected or reflected to the left, in this case. This effect of the inclination of the beam plane 65 regarding the bending plane 16 can be advantageously used to deflect high-energy radiation 19 possibly not hitting the workpiece 2 away from the normal area, where an operating person is present. From the perspective of the operator, such radiation hits the face 69 of the bending punch 5 facing away from the operator's side 70.

An advantageous variant of embodiment of the method according to the invention is that before the start of the irradiation for local heating of the deformation zone, the worpiece 2 is fixed in its position relative the die arrangement 3 by means of a retaining element, in particular by means of the bending punch 5, for example by pressing the bending punch 5 with a limited force against the workpiece 2 bearing against the contact surface 11. The fixing force used therefor only makes up a relatively small part of the deformation force needed for the actual bending process, but it effects that the workpiece 2 does not change its position relative the die arrangement 3, which can appear due to thermal stress and resulting deformation, and the deformation is effected exactly at the position predetermined. Similar to FIG. 7, the workpiece 2 can in this case be slightly deformed due to the fixation at the die arrangement 3, but this is essentially only an elastic deformation, and the local heating of the deformation zone 17 is effected afterwards. In this way, it is ensured that the workpiece 2 is bent at exactly the position desired but it is conditioned for the following plastic bending deformation by local heating of the deformation zone 17, before the disadvantageous material properties come into effect.

Due to the fact that high stresses typical for brittle material only appear in a later phase of the bending deformation, when the workpiece 2 is strongly pressed into the bending recess 12, it is furthermore advantageously possible to such determine changes of the distribution of the radiation intensity in the beam path along the bending line 21 by arranging and forming the planar fanned beams 24 that the evenness of the beam distribution is not optimal at the level of the contact surface 11, but in a later phase of the deformation, for example after a third or the half of the immersion depth of the bending punch 5, as it is shown in FIG. 7.

FIG. 7 furthermore shows a temperature sensor 71 that is spring-mounted within the bending recess 12, connected with the control device 61 of the bending press 57 and serves for measuring the temperature of the deformation zone 17 during the heating by high-energy radiation 19.

The die arrangement 3 can furthermore be such embodied that the tool base body 8 comprises a die adaptor 72 forming the contact surface 11 and the bending recess 12, shown in FIG. 7 by means of dashed lines, with said die adaptor 72 being mounted in an exchangeable way to the remaining part of the tool base body 8 containing the radiation sources 22 or the beam affecting arrangements 23.

The exemplary embodiments show possible variants of embodiment of the method or the die arrangement 3 and are not intended to limit the scope of the invention to these illustrated variants of embodiments provided herein but that there are also various combinations among the variants of the embodiments themselves and variations regarding the present invention should be executed by a person skilled in the art. All and every imaginable variants of the embodiment, arising from combining single details of the variant of embodiment illustrated and described are subject to scope of protection.

Finally, as a point of formality, it should be noted that for a better understanding of the structure of the devices according to the invention the latter and their components have not been represented true to scale in part and/or have been enlarged and/or reduced in size.

The problem addressed by the independent solutions according to the invention can be taken from the description.

Similar variants of embodiment of the method according to the invention or the die arrangement according to the invention are also known from the patent application of the applicant filed on the same filing date. The content of this patent application is herewith completely incorporated into the disclosure of the present invention, also for the purpose of incorporating characteristics of this patent application into claims of the present invention.

Mainly the individual embodiments shown in FIGS. 1; 2; 3; 4; 5; 6; 7 can form the subject matter of independent solutions according to the invention. The objectives and solutions according to the invention relating hereto can be taken from detailed descriptions of these figures.

| List of Reference Numerals | |
|---|---|
| 1 | Bending tool arrangement |
| 2 | Workpiece |
| 3 | Die arrangement |
| 4 | Press beam |
| 5 | Bending punch |
| 6 | Direction of adjustment |
| 7 | Bending die |
| 8 | Tool base body |
| 9 | Connection profile |
| 10 | Standard tool holder |
| 11 | Contact surface |
| 12 | Bending recess |
| 13 | V-shaped groove |
| 14 | V-shaped die |
| 15 | Bending plane |
| 16 | Bending line |
| 17 | Deformation zone |
| 18 | Beam exit opening |
| 19 | Radiation |
| 20 | Bottom side |
| 21 | Bending length |
| 22 | Radiation source |
| 23 | Beam affecting arrangement |
| 24 | Planar fanned beam |
| 25 | Die length |
| 26 | Diode laser bars |
| 27 | Beam exit area |
| 28 | Bar width |
| 29 | Distance |
| 30 | Cooling element |
| 31 | Microchannel cooler |
| 32 | Laser diodes arrangement |
| 33 | Positive terminal |
| 34 | Contact plate |
| 35 | Negative Terminal |
| 36 | Insulation bed |
| 37 | Connection element |
| 38 | Contact element |
| 39 | Radiation source |
| 40 | Radiation beam |
| 41 | Beam entry opening |
| 42 | Beam affecting arrangement |
| 43 | Radiation beam portion |
| 44 | Beam transfer opening |
| 45 | Beam splitter element |
| 46 | Beam deflector |
| 47 | Beam forming element |
| 48 | Section |
| 49 | Shielding element |
| 50 | Shielding device |
| 51 | Adjustment device |
| 52 | Arrow |
| 53 | Fixed stop |

-continued

| List of Reference Numerals | |
|---|---|
| 54 | Check mark |
| 55 | Double arrow |
| 56 | Retaining element |
| 57 | Bending press |
| 58 | Frame |
| 59 | Linear adjustment drive |
| 60 | Press beam |
| 61 | Control device |
| 62 | Leakage radiation |
| 63 | Sensor device |
| 64 | Camera |
| 65 | Beam plane |
| 66 | Angle of inclination |
| 67 | Cutting line |
| 68 | Depth offset |
| 69 | Face |
| 70 | Operator's side |
| 71 | Temperature sensor |
| 72 | Die adaptor |

The invention claimed is:

1. A method for bending a flat workpiece, the method comprising steps of:

providing a die arrangement comprising at least one bending die and a bending recess, wherein the at least one bending die comprises a contact surface;

conducting a bending process;

discharging from the bending recess of the die arrangement high-energy radiation comprising at least one planar fanned beam onto a workpiece to be bent bearing against the contact surface of the at least one bending die; and heating the workpiece locally before or during the bending process and using the high-energy radiation, and wherein said at least one planar fanned beam is produced by at least one beam element arranged within the die arrangement along the bending recess and the high-energy radiation is thereby approximately adjusted to a bending length of the workpiece.

2. The method according to claim 1, wherein an adjustment of a die length of the die arrangement to the bending length of the workpiece is effected by a stringing together of several bending dies.

3. The method according to claim 1, wherein the high-energy radiation is adjusted to the bending length of the workpiece by controlled shielding using a shielding element at the die arrangement.

4. The method according to claim 3, wherein the shielding element is adjustable according to a direction of the bending length until the shielding element bears against the workpiece.

5. The method according to claim 4, wherein before an activation of the high-energy radiation, bearing of the shielding element against an edge of the workpiece is checked mechanically or in a contactless way.

6. The method according to claim 3, wherein the shielding element has a reflective-coated surface at its bottom side and/or has a convex radiation diverging surface and/or is provided with a temperature monitoring.

7. The method according to claim 1, wherein a focus of the high-energy radiation caused by at least one optical component part in the die arrangement is positioned in front of the contact surface within the bending recess, resulting in that the high-energy radiation extends diverging outside the die arrangement.

8. The method according to claim 1, wherein leakage radiation exiting the die arrangement and not absorbed by the workpiece is detected by a detection process.

9. The method according to claim 8, wherein the leakage radiation is detected before heating the workpiece by harmless test radiation with low energy density.

10. The method according to claim 1, wherein a temperature of at least one place of the deformation zone of the workpiece is measured during the heating.

11. The method according to claim 10, wherein the temperature is measured in a contactless way by a thermo-optical measurement method.

12. The method according to claim 1, wherein before and during the activation of the high-energy radiation, a surrounding of the workpiece is protected against radiation by a shielding arrangement.

13. The method according to claim 1, wherein the power density and/or the exposure duration of the radiation are adjusted to the material and/or the geometric dimensions of the workpiece to be bent by a control device.

14. The method according to claim 1, wherein the performance of the high-energy radiation emitted onto the workpiece by the radiation source(s) is supervised by periodic or permanent measurement.

15. The method according to claim 1, wherein at the die arrangement, at least the bending recess is coupled to an aeration device and thus acts as a flow path for scavenging air.

16. The method according to claim 1, wherein a second bending die assembled from several component parts is configured to be optically opaque at mating surfaces of component parts or a second die arrangement is configured to be optically opaque at connection surfaces between the at least one bending and the second bending die.

17. The method according to claim 1, wherein during the heating, the temperature of the workpiece at a deformation zone is measured and fed as a value into an electronic control device, which, depending on the temperature measured, blocks, releases, effects, accelerates, decelerates a bending process and/or increases, reduces or activates the radiation performance by activating or deactivating or power control of the radiation sources in the die arrangement or of the external radiation source.

18. The method according to claim 1, further comprising:

before the application of the high-energy radiation, subjecting the workpiece to a slight, only elastic bending deformation by a bending punch and fixing the workpiece in a position by bending punch so that only the heating by discharging of radiation is activated at a bottom side of the workpiece;

subsequently, beginning an activation of the radiation and continuing the deformation immediately or after expiring of a predetermined period of time, or when the workpiece in a deformation zone obtains a certain temperature; and keeping the radiation activated until or shortly before the termination of the bending deformation.

19. A die arrangement comprising:

at least one bending die comprising a tool base body and a contact surface for bearing a workpiece to be bent by a bending punch;

a groove-shaped bending recess in the contact surface and at least one beam exit opening in the groove-shaped bending recess extending along the bending recess for discharging high-energy radiation, in the form of at least one planar fanned beam onto the workpiece bearing against the contact surface for heating a deformation zone of the workpiece; and a number of radiation sources arranged within the at least one bending die, the number of radiation sources being optionally activatable or deactivatable, being arranged at least approximately evenly along the groove-shaped bending recess behind the beam exit opening in the tool base body, and being configured to produce said at least one planar fanned beam.

20. The die arrangement according to claim 19, wherein the die arrangement is composed of several bending dies stringed together.

21. The die arrangement according to claim 19, wherein at least one adjustable shielding element for covering sections of the bending recess not being covered by the workpiece is provided at the die arrangement.

22. The die arrangement according to claim 19, wherein the tool base body of the at least one bending die has a connection profile held in a standard tool holder of a trimming press at an end section facing away from the bending recess.

23. The die arrangement according to claim 19, wherein the tool base body comprises a die adaptor forming the contact surface and the bending recess and the die adaptor is mounted in an exchangeable way to the remaining part of the tool base body containing the radiation sources.

24. A die arrangement comprising:

at least one bending die comprising a tool base body and a contact surface for bearing a workpiece to be bent by a bending punch;

a groove-shaped bending recess in the contact surface and at least one beam exit opening in the bending recess extending along the groove-shaped bending recess for discharging high-energy radiation, in the form of a planar fanned beam onto the workpiece bearing against the contact surface for heating a deformation zone of the workpiece;

at least one beam entry opening for introducing at least one concentrated radiation beam produced by a radiation source arranged outside the die arrangement;

at least one beam path following the beam entry opening; and a number of beam affecting arrangements arranged in the course of the beam path and within the at least one bending die in a way that each beam affecting arrangement temporarily and locally deflects and distributes a part of the at least one concentrated radiation beam so that the at least one concentrated radiation beam expands to be said at least one planar fanned beam and the high-energy radiation is thereby approximately adjusted to a bending length of the workpiece, said at least one planar fanned beam being guided through the beam exit opening to the workpiece in a region of the deformation zone.

* * * * *